US006461062B2

(12) United States Patent
Hofmuth et al.

(10) Patent No.: US 6,461,062 B2
(45) Date of Patent: Oct. 8, 2002

(54) APPARATUS AND METHOD FOR DEVELOPING A PHOTOGRAPHIC EMULSION CARRIER

(75) Inventors: Walter Hofmuth; Anton Pirmann, both of Munich (DE)

(73) Assignee: Agfa-Gevaert AG, Leverkusen (DE)

( * ) Notice: Subject to any disclaimer, the term of this patent is extended or adjusted under 35 U.S.C. 154(b) by 0 days.

(21) Appl. No.: 09/902,039

(22) Filed: Jul. 10, 2001

(65) Prior Publication Data

US 2002/0018653 A1 Feb. 14, 2002

(30) Foreign Application Priority Data

Jul. 22, 2000 (DE) ..... 100 35 736

(51) Int. Cl.[7] ..... G03D 3/08

(52) U.S. Cl. ..... 396/612; 396/617

(58) Field of Search ..... 396/612, 614, 396/617, 622, 624; 355/27–29

(56) References Cited

U.S. PATENT DOCUMENTS

| | | | | |
|---|---|---|---|---|
| 5,063,401 A | * | 11/1991 | Oberkersch et al. | 396/617 |
| 5,394,216 A | * | 2/1995 | Suzuki et al. | 396/614 |
| 5,414,484 A | | 5/1995 | Hofmuth et al. | 396/620 |
| 5,634,168 A | * | 5/1997 | Matsumoto et al. | 396/612 |
| 5,805,949 A | * | 9/1998 | Nozawa et al. | 355/27 |

* cited by examiner

*Primary Examiner*—D Rutledge
(74) *Attorney, Agent, or Firm*—John A. Merecki; Hoffman, Warnick & D'Alessandro

(57) ABSTRACT

An apparatus and method for developing a s photographic emulsion carrier in a plurality of processing tanks through which the emulsion carrier travels in succession, with at least one rotatable roller, the photographic emulsion carrier having a front section and an end section and the roller being arranged such that an end section of the photographic emulsion carrier comes into contact with the roller while travelling from a first to a second processing tank, the direction of rotation of the roller being designed so that the roller can wipe the end section in a direction is away from the emulsion carrier.

10 Claims, 2 Drawing Sheets

APPARATUS AND METHOD FOR DEVELOPING A PHOTOGRAPHIC EMULSION CARRIER

FIELD OF THE INVENTION

The present invention relates generally to photographic film developing equipment. More particularly, the present invention relates to an apparatus and method for developing a photographic emulsion carrier.

BACKGROUND OF THE INVENTION

A related art apparatus and method for developing a photographic emulsion carrier are described in DE 43 04 907, corresponding to U.S. Pat. No. 5,414,484. To explain more clearly the problem on which the present invention is based, FIGS. 1A to 1C show a schematic representation of the apparatus known from the related art.

FIG. 1A shows an emulsion carrier 10, which is transported from a developer tank 12 to a fixer tank 14. The two tanks are separated from one another by a partition wall 16. Two rollers 18, 20 form a draining roller pair which, besides delivering the emulsion carrier 10, has the purpose of squeezing the processing fluid from the developer tank 12 from the emulsion carrier 10 prior to the emulsion carrier 10 entering the fixer tank 14. Guide devices 22 are used to feed the emulsion carrier 10 into an entry roller pair 24, 26 of the fixer tank 14. As can be seen from the representation in FIG. 1B, the developer fluid is not wiped off fully, so that a developer-fluid residue denoted by 28 remains adhering to an end section 30 of the emulsion carrier 10. Before the emulsion carrier 10 is immersed in the fixer fluid in the fixer tank 14, this residue 28 (see FIG. 1C) trickles down under the effect of gravity from the end section 30 of the emulsion carrier 10, along the emulsion carrier 10, towards its front region while forming drips 31 which may be in the range of several centimeters. Continued developing takes place in the vicinity of the drips 31, and this is clearly visible on the emulsion carrier 10 as dark regions with a higher optical density, after the complete developing process.

In conventional X-ray examinations, for example of an arm, a leg, the stomach etc., these dark regions are not a great problem since the body region to be examined is normally positioned in the middle of the exposure region. Faults due to the film processor at the edges of the X-ray film, for example scratches, density differences etc., are therefore acceptable to some extent, the diagnosis is not compromised.

The situation is very different for mammography, in which the diagnostic region extends as far as the outermost area of the film. In this case, no faults are therefore allowed. Degradations in the image quality due to the said drips can lead to cases of very serious misdiagnosis.

SUMMARY OF THE INVENTION

The present invention provides an apparatus and method for developing a photographic emulsion carrier, in such a way that it is possible to provide developed emulsion carriers with high imaging quality—especially in the edge region as well—so as to permit use for highly sensitive applications, for example mammography.

A first aspect of the invention provides an apparatus for developing a photographic emulsion carrier in a plurality of processing tanks, through which the emulsion carrier travels in succession, the apparatus including a rotatable roller, the photographic emulsion carrier having a front section and an end section and the roller being arranged in such a way that an end section of the photographic emulsion carrier comes into contact with the roller while travelling from a first processing tank to a second processing tank, wherein a direction of rotation of the roller is designed so that the roller wipes the end section in a direction away from the emulsion carrier.

A second aspect of the invention provides a method for developing a photographic emulsion carrier in a plurality of processing tanks, through which the emulsion carrier, which has a front section and an end section, travels in succession, comprising the following steps:

a) transporting the emulsion carrier from a first processing tank;

b) bringing the end section of the emulsion carrier into contact with a rotatable roller; and c) rotating the roller in a direction such that the roller wipes the end section in a direction away from the emulsion carrier.

The solution according to the invention is based on the discovery that the formation of drips can be minimized if the fluid accumulating at the end section of the emulsion carrier and adhering there can be wiped off by a roller which rotates away from the emulsion carrier. This very significantly reduces the length of the drips which form and, with optimal design, even prevents any drips from forming.

It is particularly useful if the roller is part of a transport device which is present in any case, or if a roller separately added for the wiping process is coupled to the transport device for moving this roller.

Since the drips are formed on the side of the emulsion carrier where gravity acts, the roller is arranged in such a way that it touches the end section on this side.

If the wiping roller is part of a transport or squeezing device, or if its surface is coupled to the surface of a transport or squeezing roller, then this has the result that the wiping roller is always wetted with fluid. It has been found that this wetting has a positive effect in terms of minor build-up of the fluid accumulating at the end section of the emulsion carrier. This wetting can also be achieved by direct or indirect contact of the roller surface with a roller turning in the bath fluid.

The apparatus according to the invention may also comprise a holder element which can support the emulsion carrier during the wiping. This ensures that the emulsion carrier, especially its end section, is not missed during the wiping process.

The holder element can be produced by configuring one of the guide apparatuses, which are in any case provided, for forwarding the emulsion carrier from one processing tank to the next, in such a way that it can fulfil the function of the holder element.

Of course, the invention also comprises the option that the emulsion carrier may be sent, prior to introduction into the next processing tank, to a separate station in which the wiping process is carried out with a separate roller. It is useful, however, to design the elements which are present in any case, such as transport rollers and guide apparatuses, in such a way that a gap is formed between a roller of the transport device and a guide apparatus serving as the holder element, the guide apparatuses forwarding the emulsion carrier so that its end section enters the gap for the wiping to be carried out.

BRIEF DESCRIPTION OF THE DRAWINGS

These and other features of the invention are set forth in the appended claims. An exemplary embodiment of the invention will be described in more detail below with reference to the appended drawings, in which:

DETAILED DESCRIPTION OF THE INVENTION

Figure 1A:
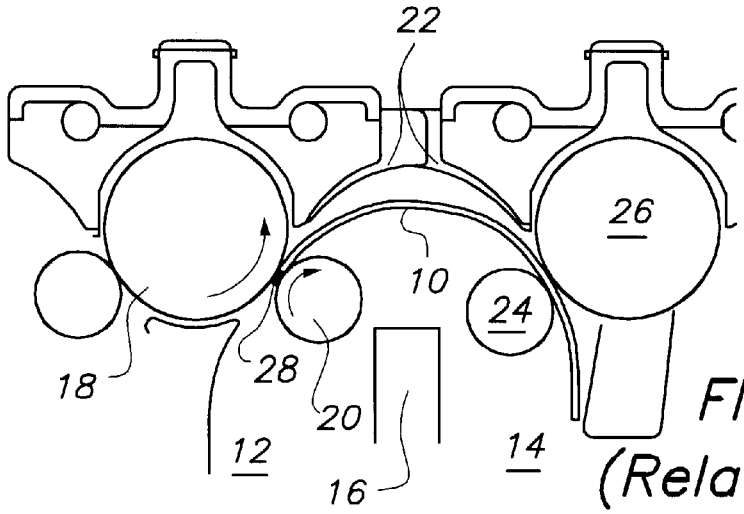
FIG. 1A (Related Art)
FIGS. 1A to 1C represent a schematic representation of the transport of an emulsion carrier in an apparatus known from the related art for developing a photographic emulsion carrier.
Figure 1B:
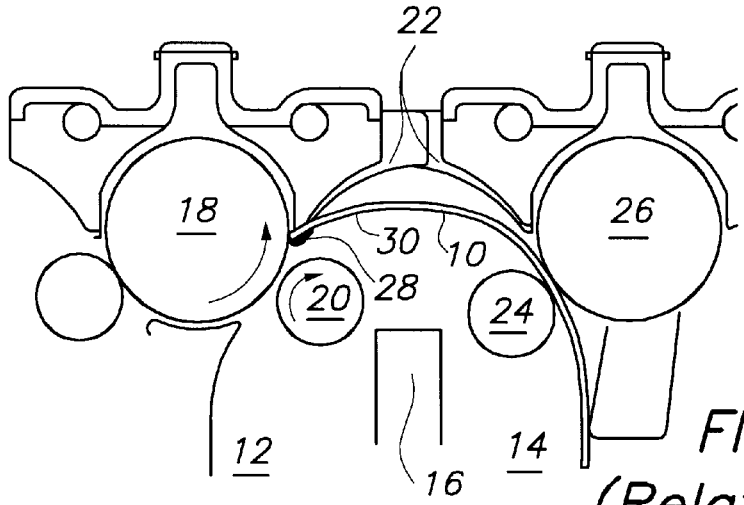
FIG. 1B (Related Art)
Figure 1C:
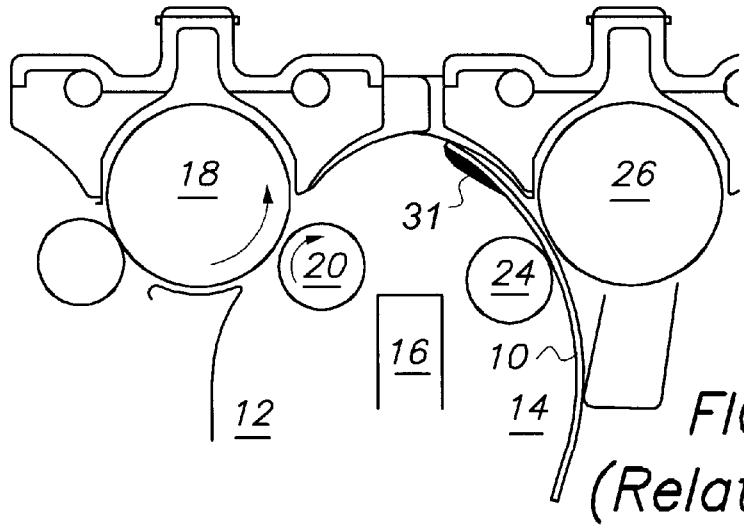
FIG. 1C (Related Art)
Figure 2A:
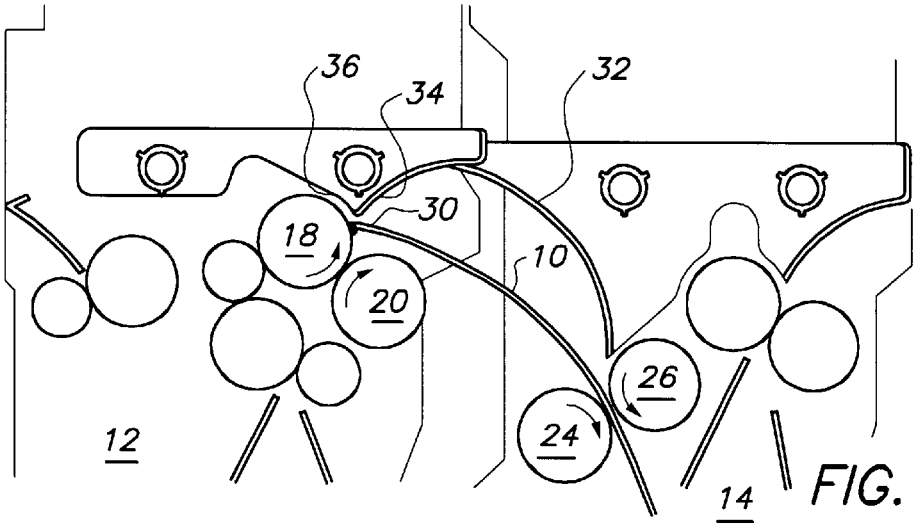
FIGS. 2A to 2C represent a schematic representation of the transport of an emulsion carrier in an apparatus according to the invention.
Figure 2B:
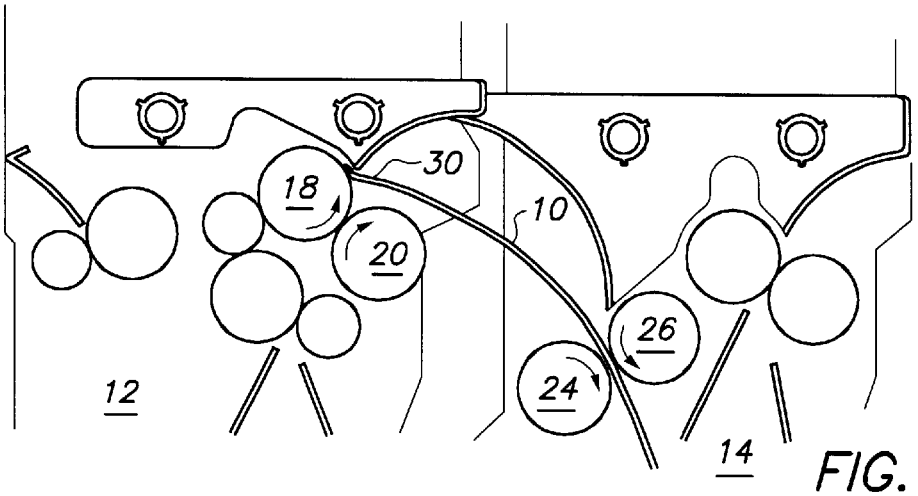
Figure 2C:
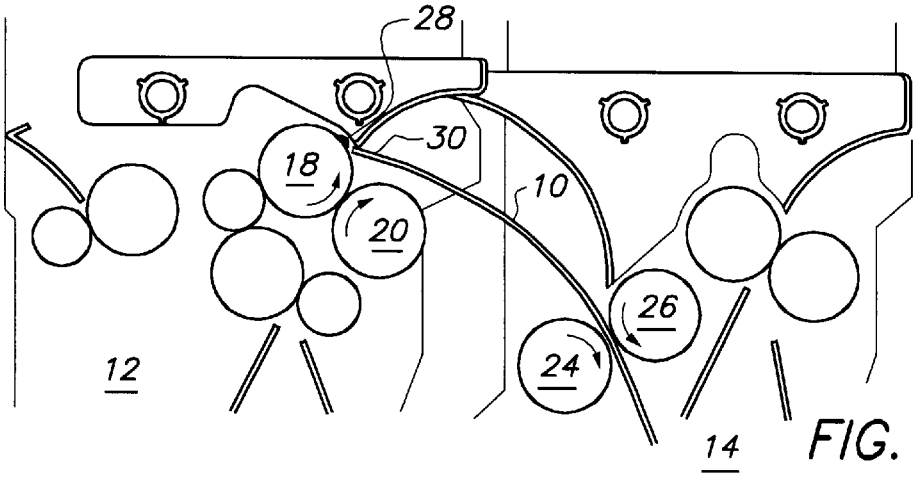

In FIGS. 2A to 2C, elements which correspond to those already discussed in connection with FIGS. 1A to 1C are denoted by the same reference numbers.

As can be seen from FIGS. 2A to 2C, the guide apparatus 32 is configured in such a way that the emulsion carrier 10 is not immediately released after leaving the last roller pair 18, 20 of a developer tank 12, but rather its end section 30 drops back onto an edge 34 of the guide apparatus 32 and, because of its intrinsic tension, it enters a gap 36 which is formed between the roller 18 and the guide apparatus 32 acting as a holder element. In the gap 36, the bottom of the end section 30 of the emulsion carrier 10 comes into contact essentially tangentially with the roller 18. The emulsion carrier 10 pauses for a brief moment in this position, with the roller 18 rotating opposite to the direction the emulsion carrier 10 is transported. By this means the end section is wiped in a direction away from the emulsion carrier 10, before the emulsion carrier 10, already gripped by the entry roller pair 24, 26 of the fixer tank 14, is transported further. By suitable design of the edge 34, it is possible to ensure that developer residues possibly remaining on the side of the emulsion carrier 10 facing vertically upwards are wiped off at the edge 34. As can be seen from FIG. 2C, the developer residues 28 present on the bottom of the end section 30 of the emulsion carrier 10 are transferred to the roller 18 and removed by it. This prevents the formation of drips.

The insertion into the gap 36 is effectively helped if the roller pair 18, 20 is arranged so that the plane defined by the roller axes forms an angle—e.g., between 30° and 60°—with a horizontal plane, the roller 18 being positioned higher than the roller 20. The result of this measure is that, during the wiping process, the end section 30 of the emulsion carrier 10 comes into contact only with the counter-rotating roller 18 but not with the co-rotating roller 20.

The foregoing description of the present invention has been presented for purposes of illustration and description. It is not intended to be exhaustive or to limit the invention to the precise form disclosed, and many modifications and variations are possible in light of the above teaching. Such modifications and variations that may be apparent to a person skilled in the art are intended to be included within the scope of this invention.

What is claimed is:

1. Apparatus for developing a photographic emulsion carrier in a plurality of processing tanks, through which the emulsion carrier travels in succession, the apparatus including a rotatable roller, the photographic emulsion carrier having a front section and an end section and the roller being arranged in such a way that an end section of the photographic emulsion carrier comes into contact with the roller while travelling from a first processing tank to a second processing tank, wherein a direction of rotation of the roller is designed so that the roller wipes the end section in a direction away from a direction of travel of the emulsion carrier.

2. Apparatus according to claim 1, wherein the apparatus further comprises transport devices which deliver the emulsion carrier through the individual processing tanks, the roller being part of one of the transport devices or being coupled to the transport device for moving the roller.

3. Apparatus according claim 1, wherein the roller is arranged in such a way that it touches the end section of the emulsion carrier on the side where gravity acts.

4. Apparatus according to claim 1, wherein the roller is wetted.

5. Apparatus according to claim 1, wherein the apparatus further comprises a holder element for supporting the emulsion carrier during the wiping.

6. Apparatus according to claim 5, wherein the apparatus further comprises a guide apparatus for forwarding the emulsion carrier from one processing tank to the next, the holder element being part of the guide apparatus.

7. Apparatus according to claim 6, wherein the guide apparatus is designed in such a way that a gap is formed between the roller and the holder element, the guide apparatus being capable of guiding the emulsion carrier so that its end section enters the gap for the wiping to be carried out.

8. Method for developing a photographic emulsion carrier in a plurality of processing tanks, through which the emulsion carrier, which has a front section and an end section, travels in succession, comprising the following steps:

a) transporting the emulsion carrier from a first processing tank;

b) bringing the end section of the emulsion carrier into contact with a rotatable roller; and c) rotating the roller in a direction such that the roller wipes the end section in a direction away from a direction of travel of the emulsion carrier.

9. Method according to claim 8, wherein the end section of the emulsion carrier is supported by a holder element during the wiping.

10. Method according to claim 9, wherein, prior to step c), the end section of the emulsion carrier enters a gap between the roller and the holder element, and is held there during the wiping.

* * * * *